US005482291A

United States Patent [19]

Houriet, Jr. et al.

[11] Patent Number: 5,482,291

[45] Date of Patent: Jan. 9, 1996

[54] DART BOARD APPARATUS WITH INDEPENDENTLY SUPPORTED DOUBLE BULL SEGMENT

[75] Inventors: John W. Houriet, Jr., Yardley; Peter Feuer, Rydal; William A. Rollin, III, Hatboro, all of Pa.

[73] Assignee: Merit Industries, Inc, Bensalem, Pa.

[21] Appl. No.: 248,379

[22] Filed: Apr. 25, 1995

[51] Int. Cl.[6] ..... F41J 3/00

[52] U.S. Cl. ..... 273/376

[58] Field of Search ..... 273/371, 374–376, 273/386

[56] References Cited

U.S. PATENT DOCUMENTS

| | | | |
|---|---|---|---|
| 4,057,251 | 11/1977 | Jones et al. | 273/95 R |
| 4,836,556 | 6/1989 | De Vale et al. | 273/376 |
| 4,976,441 | 12/1990 | Kim | 273/376 |
| 5,193,817 | 3/1993 | Pan | 273/376 |
| 5,275,418 | 1/1994 | Yiu | 273/376 |

*Primary Examiner*—Paul E. Shapiro

*Attorney, Agent, or Firm*—Panitch Schwarze Jacobs & Nadel

[57] ABSTRACT

A dart board apparatus including a housing having a spider located therein. The spider is generally circular in shape and has a series of circumferentially and radially extending ribs which define a plurality of target segment openings, and a circumferential center rib which defines a center opening. A plurality of target segments are slidably disposed in the target segment openings. An annular outer bull segment, having a target surface with a center opening, and a generally tubular sidewall with at least two slots therethrough, is also provided. The outer bull is slidably disposed for movement within the center opening in the circumferential center rib. An inner bull segment is slidably disposed within the center opening in the outer bull segment. The inner bull segment includes at least two spokes, in an aligned position with the slots in the outer bull segment sidewall. Each spoke includes a first end connected to the inner bull, and a second end in slidable contact with the circumferential center rib so that the inner bull segment may slide independently of movement of the outer bull segment. At least one sensor is associated with each target segment, the outer bull segment and the inner bull segment.

5 Claims, 3 Drawing Sheets

DART BOARD APPARATUS WITH INDEPENDENTLY SUPPORTED DOUBLE BULL SEGMENT

FIELD OF THE INVENTION

The present invention relates to electronically scored dart games, and more particularly, to a dart board apparatus for an electronically scored dart game in which the inner bull segment is supported independently from the outer bull segment.

BACKGROUND OF THE INVENTION

The dart board, often referred to as the "clock", is usually about 18" in diameter and has a playing area of about 13". The dart board has a double outer ring, a treble-value inner ring, and generally, two center bull rings (outer and inner), and 20 adjacent numbered scoring areas. In a standard dart games, the players throw darts at the circular target aiming for the different scoring areas. However, due to the danger associated with sharp, metal-pointed darts, electronically scored dart games using "soft-tip" darts were developed.

Electronically scored dart games are generally well-known in the art and are commercially available from a variety of sources, including Merit Industries, Inc., the assignee of the present invention. Such dart games generally comprise a cabinet or housing with a decorative front surface which includes a specialized dart board adapted to receive, capture, and hold one or more darts having a tip made of a flexible plastic with a relatively blunt point. Soft-tip darts of this type closely resemble conventional metal-tip darts in appearance, flight characteristics and target-striking characteristics, but are much safer in that they are incapable of piercing a person's skin or causing damage to walls or other surroundings adjacent to the dart board.

Generally, an electronically scored dart board comprises a circular target divided into different scoring areas, with each scoring area including a target segment. The target segments, which are usually formed of a plastic material, are arranged in an array or pattern which generally corresponds to scoring areas of a traditional dart board. Each target segment has a target surface, which includes a plurality of generally circular openings sized for receiving and holding a tip of a plastic-tipped dart. The target segments are each independently slidably supported within a surrounding support structure, commonly referred to as a spider, having a plurality of circumferential and radially extending ribs which define target segment openings.

Generally, a single bulls-eye segment or a split bulls-eye, comprised of an outer bull segment and an inner bull segment, is located at the center of the board. A single bulls-eye segment is similar to the other target segments in that it is slidably supported in an opening in the spider. In the case of a split bulls-eye, the outer bulls-eye segment is slidably disposed in the circumferential center rib opening in the spider, similar to a single bulls-eye segment. The inner bull segment is generally slidably disposed in a center opening in the outer bull segment and is supported solely by the outer bull segment. When the tip of a dart is received within a target segment or a bull segment, the force of the dart striking the target or bull segment results in the target or bull segment moving rearwardly in its opening with respect to the support structure.

Each target segment, including the outer and inner bull segments, have corresponding electrical contacts combined into a switch matrix mounted on a surface behind the target segments. The electrical contacts generate an electrical signal to indicate a score when a target plate slides rearwardly after receiving a dart. Electronics associated with the game sense each such score signal, calculate the score for each player, and provide an indication of each player's score on a visual display, such as plurality of lights, light-emitting diodes or a cathode ray tube.

Although the electronically scored dart games have been well received, skilled players are sometimes reluctant to use an electronic board because of the possibility of the darts not sticking or of a misread. Dart games are games of great skill, and it is important that the electronic game keep score as accurately as possible, with the possibility of misscoring or misreads being virtually zero. However, in the known electronic dart board apparatus, it is possible to have a misread when a dart strikes the outer bull segment or the inner bull segment. Because the inner bull segment is generally solely supported by the outer bull segment, it is possible that even though a dart strikes the inner bull, both segments move inward and contact the corresponding electrical contacts generating an electrical signal which indicates an outer bull strike. For skilled players, even one misread in 100 throws is unacceptable.

The present invention overcomes the drawbacks associated with the generally-known inner bull segments which are supported by the outer bull segments for electronic dart board apparatuses by providing an independent mounting system for the inner bull segment.

SUMMARY OF THE INVENTION

Briefly stated, the present invention is a dart board apparatus including a housing having a spider located therein. The spider is generally circular in shape and has a series of circumferentially and radially extending ribs which define a plurality of target segment openings, and a circumferential center rib which defines a center opening. A plurality of target segments are slidably disposed in the target segment openings. An annular outer bull segment, having a target surface with a center opening, and a generally tubular sidewall with at least two slots therethrough, is also provided. The outer bull is slidably disposed for movement within the center opening in the circumferential center rib. The dart board apparatus also includes an inner bull segment slidably disposed within the center opening in the outer bull segment. The inner bull segment includes at least two spokes in an aligned position with the slots in the outer bull segment sidewall. Each spoke includes a first end connected to the inner bull, and a second end in slidable contact with the circumferential center rib so that the inner bull segment may slide independently of movement of the outer bull segment. At least one sensor is associated with each target segment, the outer bull segment and the inner bull segment.

BRIEF DESCRIPTION OF THE DRAWINGS

The foregoing summary, as well as the following detailed description of preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF PREFERRED EMBODIMENT

Figure 1:
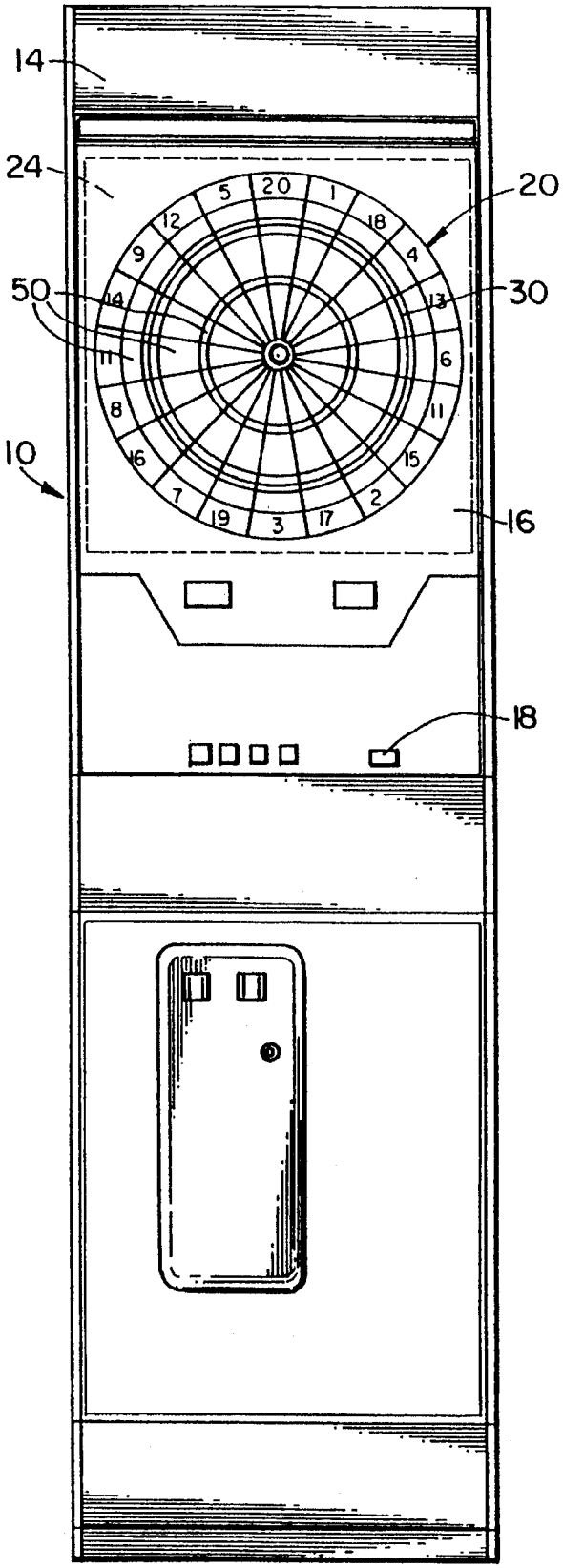
FIG. 1 is a front elevation view of an electronic dart game apparatus in incorporating a preferred embodiment of the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the dart board apparatus and designated parts thereof. The terminology includes the words above specifically mentioned, derivatives thereof and words of similar import.

Referring to the drawings, wherein like numerals indicate like elements throughout, there is shown in FIGS. 1–6 a preferred embodiment of an electronically scored dart game apparatus, generally indicated as 10. The dart game apparatus 10 is comprised of a generally elongated cabinet 12. The upper portion of the cabinet 12 includes a generally outwardly extending canopy or cover member 14 which, in addition to being aesthetically pleasing, may include one or more lighting fixtures (not shown). The cabinet 12 has a front surface 16 which has a plurality of push buttons and lights, shown generally as 18, which are used for interaction between the dart game apparatus 10 and game players. It is understood by those of ordinary skill in the art that the number of buttons and lights 18 may vary depending on the complexity of the game and the number of selection options offered. The primary feature of the cabinet front surface 16 is an electronic dart board apparatus 20 (hereinafter "dart board" 20).

Figure 3:
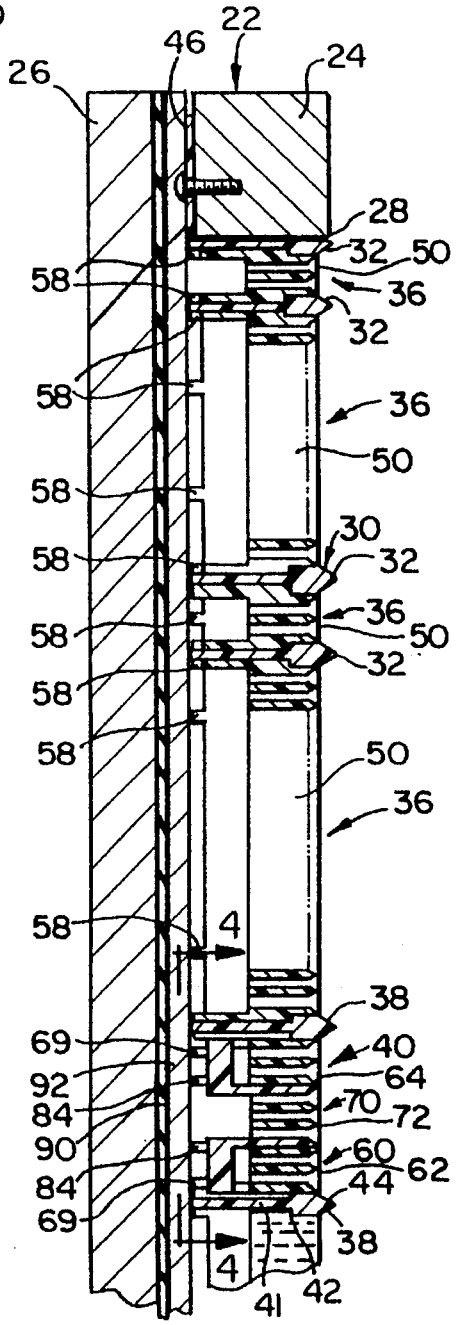
FIG. 3 is a section view of the dart board apparatus shown in FIG. 2 taken along lines 3—3 in FIG. 2.
Figure 2:
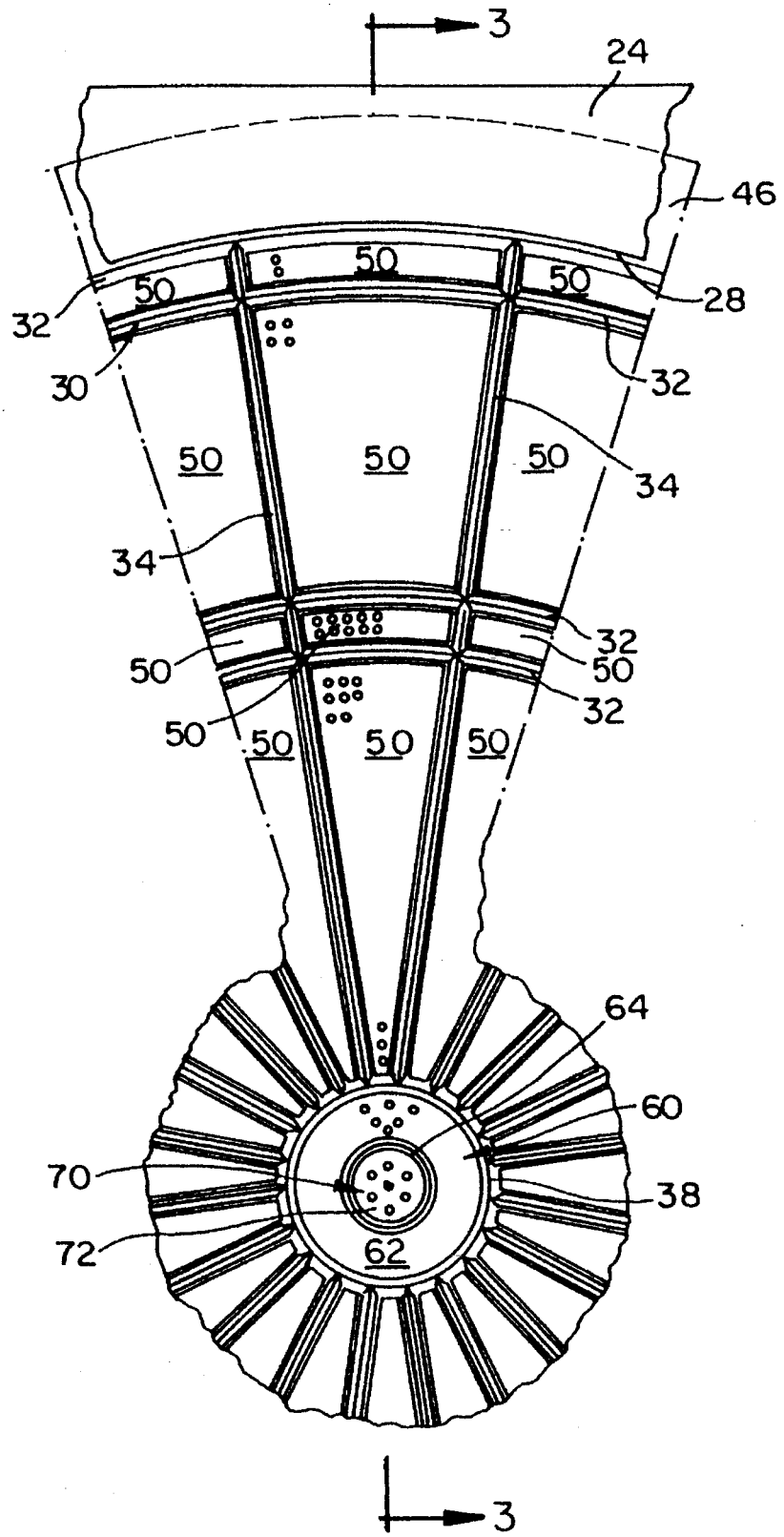
FIG. 2 is an enlarged view of a portion of the dart board apparatus of the electronic dart game apparatus shown in FIG. 1.

Referring now to FIGS. 1–3, the dart board 20 is comprised of a housing 22 which includes a front panel 24 and a back panel 26. The front panel 24 includes a circular opening 28. A spider 30, which is described in more detail below, is located in the opening 28 in the housing 22. In the preferred embodiment, the front and back panels 24 and 26 are square in form and made from a high-density particle board. The back panel 26 is removably attached to the front panel 24 by four fasteners (not shown). The construction of front and back panels 24 and 26 is known to those of ordinary skill in the art, accordingly further description is not required. In addition, it is similarly understood by those of ordinary skill in the art from the present disclosure that the front and back panels can be made of various other materials such as plastic and the size and configuration may be varied or adapted to suit particular applications.

Referring now to FIGS. 1–6, the spider 30 is shown in detail. The spider 30 is generally circular in shape and has a series of circumferentially and radially extending ribs 32 and 34 respectively, which define a plurality of target segment openings 36. A circumferential center rib 38 defines a center opening 40. Each rib 32, 34 and 38, generally includes a narrow portion 41 which terminates at a retaining shoulder 42 adjacent to the front surface of the spider 30. The top 44 of each rib 32, 34 and 38 is tapered to a point. An annular flange 46 is located around the periphery of the spider 30.

In the preferred embodiment, the spider 30 is molded as a unitary assembly from a polymeric material and is approximately 15½" in diameter with twenty radial ribs and five circumferential ribs including the circumferential center rib 38. The size and spacing of the ribs 32, 34 and 38 are in a configuration of a regulation dart board. The spider 30 is preferably injection molded. However, other manufacturing means such as casting or machining can be employed if desired. The construction of a basic spider is generally known to those of ordinary skill in the art, accordingly further explanation is not required.

Referring again to FIGS. 1–3, a plurality of target segments 50 are slidably disposed in the target segment openings 36 of the spider 30. Each target segment 50 includes a target surface 52, having a plurality of generally circular openings defined therein for receiving the tip of a dart (not shown) in a manner which is generally well-known for electronically-scored dart games. The target segments 50 further include sidewalls 54 having a recess 56 defined in a complementary position to the shoulders 42 on the ribs 32, 34 and 38. Switch contact members 58 extend from the sidewalls 54 in a manner which is generally well-known for electronically scored dart games.

Preferably, the target segments 50 are formed of a polymeric material by injection molding. However, the form and manufacture of target segments 50 is well known to those of ordinary skill in the art, accordingly further explanation is not required.

Figure 4:
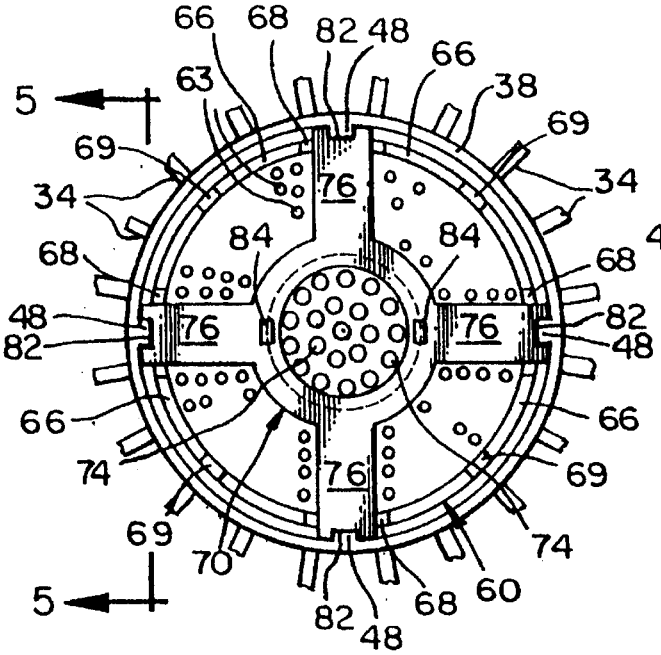
FIG. 4 is an enlarged rearward view of a portion of the dart board apparatus shown in FIG. 2 taken along lines 4—4 in FIG. 3.
Figure 5:
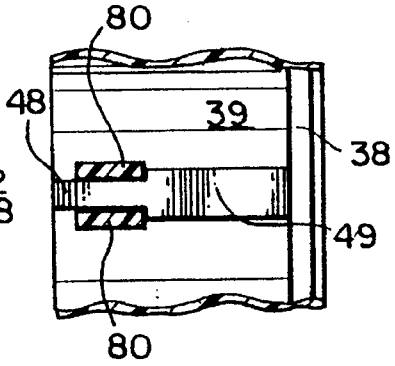
FIG. 5 is a partial section view taken along lines 5—5 in FIG. 4.
Figure 6:
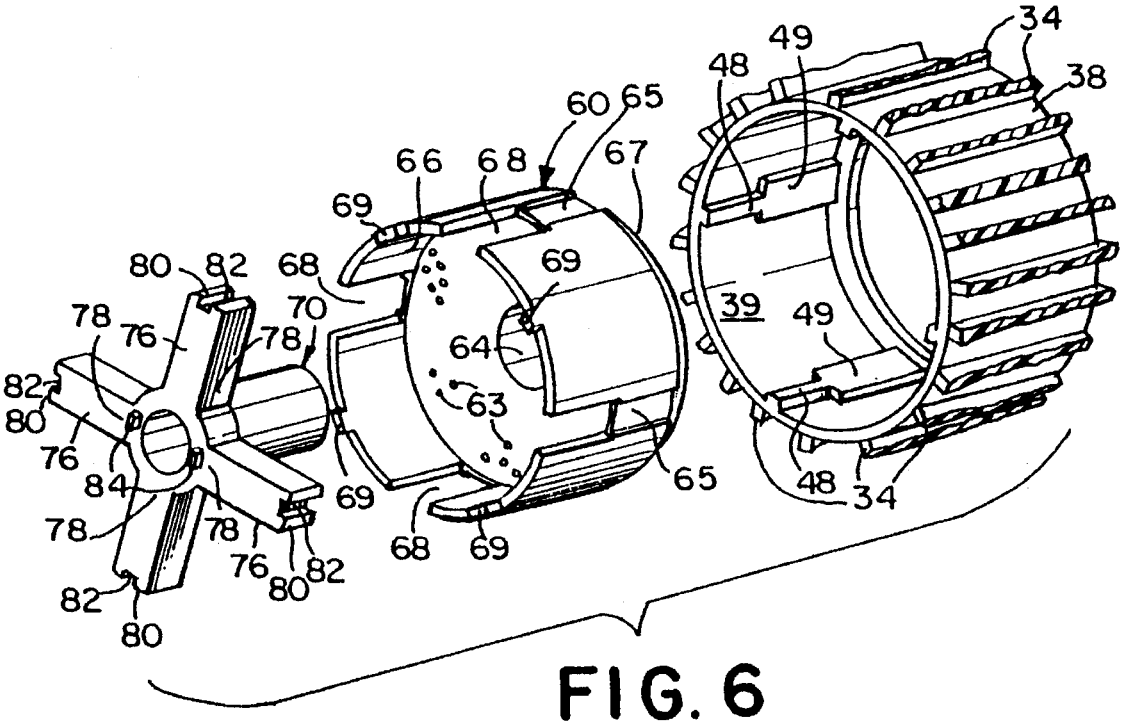
FIG. 6 is an unassembled perspective view of a center portion of the dart board apparatus shown in FIG. 2.

Referring to FIGS. 4–6, the circumferential center rib 38 has an inner sidewall 39. At least two radially disposed lands 48 are located on the inner sidewall 39 of the circumferential center rib 38. A stop member 49 is affixed in at least one position on the inner sidewall 39 of the circumferential center rib 38 adjacent to the radially disposed lands 48. Preferably, there are four (4) lands 48 spaced equally around the inner sidewall 39 of the circumferential center rib 38. Preferably, each land 48 includes a stop member 49 in the form of a shoulder adjacent to the land 48. However, it is understood by those skill in the art from the present disclosure that the size and shape of the lands 48 and the stop members 49 can be varied, if desired, for particular applications.

Referring now to FIGS. 2–6, an annular outer bull segment 60 is provided. The annular outer bull segment 60 has a target surface 62 with a center opening 64 defined therethrough. The target surface 62 includes a plurality of generally circular openings 63 for receiving the tip of a dart (not shown) in a manner which is generally known for electronically-scored dart games. The outer bull segment 60 also includes a generally tubular sidewall 66 with at least two slots 68 therethrough. The outer bull segment side wall 66 has an outer diameter which is designed for a clearance fit with the circumferential center rib 38. Preferably, four slots 68 are defined in the side wall 66 of the outer bull segment 60 and the slots 68 in the outer bull segment 60 are circumferentially spaced apart approximately equally. An upper recess 67 is formed along the top of the tubular side wall 66 in a complementary position to the shoulder 42 on the circumferential center rib 38. Grooves 65 are located on the sidewall 66 and extend from the ends of the slots 68 to the upper recess 67. The grooves 65 in the tubular sidewall 66 of the outer bull segment 60 are designed for a clearance fit around the stop members 49. Switch contact members 69 are attached to the ends of the tubular side wall 66. The outer bull segment 60 is slidably disposed for movement within the circumferential center rib 38, and the radially disposed lands 48 located on the inner side wall 39 of the circumferential rib 38 are in an aligned position with the slots 68 in the outer bull segment side wall 66. Preferably, the outer bull segment 60 is circular in form and injection-molded from a polymeric material. However, it is understood by those of ordinary skill in the art from the present disclosure that the outer bull segment 60 can be made of other suitable materials and be formed by other means such as machining or a combination of molding and machining.

Referring now to FIGS. 3, 4 and 6, the dart board 20 further includes an inner bull segment 70 slidably disposed in the center opening 64 in the outer bull segment 60. The outer diameter of the inner bull segment 70 is smaller than the inner diameter of the center opening 64 in the outer bull 60 to provide a clearance fit for unrestricted movement of the inner bull segment 70 with respect to the outer bull segment 60. The inner bull segment 70 includes a target surface 72 having a plurality of generally circular openings 74 for receiving a tip of a dart (not shown) in a manner which is generally well-known for electronically scored dart games. The inner bull segment 70 further includes at least two spokes 76, and preferably four spokes 76, in an aligned position with the slots 68 in the outer bull segment sidewall 66 and with the lands 48 on the inner side wall 39 of the circumferential center rib 38. Each spoke 76 includes a first end 78 connected to the inner bull segment 70, and a second end 80 in slidable contact with the circumferential center rib 38 so that the inner bull segment 70 may slide independently of the movement of the outer bull segment 60. Complementary grooves 82 to the lands 48 are included on the second ends 80 of the spokes 76. The grooves 82 in the second ends 80 of the spokes 76 are sized to provide a clearance fit on the lands 48 on the inner wall 39 of the circumferential rib 38 to provide for easy, slidable movement. The stop members 49 on the circumferential center rib 38 limit the motion of the center bull segment 70 in a first direction, i.e. out of the front of the dart board 20 but do not inhibit rearward movement of the inner bull segment 70. Switch contact members 84 are provided on the back of the inner bull segment 70.

Preferably the inner bull segment 70 is injection-molded from a polymeric material. In the preferred embodiment, four (4) spokes 46 are connected to the inner bull segment 70 and the spokes 76 are circumferentially spaced apart approximately equally. However, it is understood by those of ordinary skill in the art from the present disclosure that the inner bull segment 70 may be made from various other manufacturing processes such as machining or a combination of molding and machining. Additionally, the number of spokes 76 can be varied, if desired, to suit particular applications. For example, three spokes or five spokes 76 could be utilized with the inner bull segment 70 if desired. However, there must be at least two spokes 76 attached to the inner bull segment 70 so that the inner bull segment 70 is supported by the circumferential rib 38 of the spider 30 for movement independently of the movement of the outer bull segment 60. Additionally, those of ordinary skill in the art will understand from the present disclosure that the system of grooves 82 formed on the spokes 76 which are slidably disposed over the lands 48 on the circumferential center rib 38 are optional, and if used, their configuration can be varied to utilize various shapes. For example, lands (not shown) could be formed on the second ends 80 of the spokes 76 and complementary grooves (not shown) could be located on the inner wall 39 of the circumferential rib 38. Alternatively, the second ends 80 of the spokes 76 can be flat, and two complementary lands (not shown) can be located on the inner wall 39 of the circumferential rib 38 on either side of the second end 80 of each spoke 76 or a complementary groove (not shown) could be located in the inner wall 39 of the circumferential center rib 38 for each spoke 76, depending on the length of the spoke 76. It is similarly understood that the system of lands 48 and grooves 82 may be used on fewer than all of the spokes 76.

Referring to FIG. 3, a switch membrane 90 and a rubber sheet 92 are sandwiched between the back panel 26 and the combination of the front panel 24 and the spider member 30. The rubber sheet 92 presses against the switch contact members 58, 69 and 84 of the target segments 50, the outer bull segment 60 and the inner bull segment 70 respectively, to bias the segments 50, 60 and 70 to a forwardmost initial, rest position with respect to the spider 30, with the recesses 56 and 67 on the target segments 50 and the outer bull segment 60 respectively, contacting the shoulders 42 on the radial and circumferential ribs 32, 34 and 38, and the spokes 76 on the inner bull segment 70 contacting the stop members 49.

The switch contact members 58, 69 and 84 on the target segments 50, the outer bull 60 and the inner bull 70 respectively, are aligned with at least one sensor in the switch membrane 90. Preferably, the switch membrane 90 includes two layers of polyester film (not shown) having conductive silver ink circuits printed thereon in a manner which is generally known by those of ordinary skill in the art. A polyester film spacer layer (not shown) having cutouts in complimentary positions to the conductive silver ink circuits and the switch contact members 58, 69 and 84 on the target segments 50, the outer bull segment 60 and the inner bull segment 70, is interposed between the two layers having the conductive silver circuits. This type of switch membrane 90 is generally known to those of ordinary skill in the art, accordingly further description is not required. However, it is understood by those of ordinary skill in the art from the present disclosure that the type of switch used to indicate a score is not considered limiting, and other types of switches can be used in conjunction with the present invention, such as spring biased switches or switches comprised of a silicone dome with a carbon contact located over printed circuit contacts.

Having provided a description of the structure of the dart board 20, a brief description of the operation of the dart board 20 follows, specifically with reference to the operation the outer bull segment 60 and the inner bull segment 70.

Referring now to FIG. 3, the outer bull segment 60 and the inner bull segment 70 are shown in the initial, rest position. When a player throws a dart which hits the target surface 62 of the outer bull segment 60, the outer bull segment 60 moves rearwardly in the circumferential center rib 38, with the grooves 65 in the tubular side wall 66 sliding along the outside of the stop members 49 to prevent rotation of the outer bull segment 60. The outer bull segment 60 moves independently of and without moving the inner bull 70. One or more switch contact members 69 on the outer bull segment 60 are pressed against the rubber sheet 92 and activate the corresponding electrical contacts (now shown) on the membrane switch 90 to indicate a score. The rubber sheet 92 then returns the outer bull segment 60 to its initial, rest position with the recess 67 contacting the shoulder 42 on the circumferential center rib 38.

When a player throws a dart which hits the inner bull segment target surface 72, the inner bull segment 70 slides rearwardly with the spokes 76 sliding along the lands 48 on the circumferential center rib 38, independently of the outer bull segment 60. One or more switch contact members 84 on the inner bull segments 70 press against the rubber sheet 92 and to activate the corresponding electrical contact (not shown) on the membrane switch 90 to indicate a score. The rubber sheet 92 then returns the inner bull segments 70 to its initial, rest position with the spoke 76 contacting the stop member 49.

Because the inner bull segment 70 slides along the lands 48 on the circumferential rib 38 independent of the outer bull segment 60, the possibility of having a misscore is reduced in comparison to the prior art devices where the inner bull segment is carried by the outer bull segment.

It will be appreciated by those of ordinary skill in the art that changes could be made to the embodiment described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A dart board apparatus comprising:

a housing;

a spider being generally circular in shape and having a series of circumferentially and radially extending ribs which define a plurality of target segment openings, and a circumferential center rib which defines a center opening, located in the housing;

a plurality of target segments slidably disposed in the target segment openings;

an annular outer bull segment, having a target surface with a center opening, and a generally tubular sidewall with a least two slots therethrough, the outer bull segment being slidably disposed for movement within the circumferential center rib;

an inner bull segment slidably disposed within the center opening in the outer bull segment;

the inner bull segment including at least two spokes, in an aligned position with the slots in the outer bull segment sidewall, each spoke includes a first end connected to the inner bull, and a second end in slidable contact with the center rib so that the inner bull segment may slide independently of the movement of the outer bull segment; and at least one sensor associated with each target segment, the outer bull segment and the inner bull segment.

2. The apparatus of claim I wherein the circumferential center rib has an inner sidewall, at least two radially disposed lands are located on the inner sidewall of the circumferential center rib in an aligned position with the slots in the outer bull segment sidewall, and complementary grooves to the radially disposed lands are included on the second ends of the spokes.

3. The apparatus of claim 2 further comprising a stop member affixed in at least one position on the inner sidewall of the circumferential center rib adjacent to the radially disposed lands which limits the motion of the inner bull segment in a first direction.

4. The apparatus of claim 1 wherein four slots are defined in the sidewall of the outer bull segment and four spokes are connected to the inner bull segment.

5. The apparatus of claim 1 wherein the slots in the outer bull segment sidewall and the spokes are circumferentially spaced apart approximately equally.

* * * * *

UNITED STATES PATENT AND TRADEMARK OFFICE

CERTIFICATE OF CORRECTION

PATENT NO. : 5,482,291

DATED : January 9, 1996

INVENTOR(S) : John W. Houriet, Jr., et al.

It is certified that error appears in the above-indentified patent and that said Letters Patent is hereby corrected as shown below:

Title page, Item [21] appl. no.: "248,379" should read -- 428,379 --.

Signed and Sealed this

Twentieth Day of August, 1996

*Attest:*

BRUCE LEHMAN

*Attesting Officer*

*Commissioner of Patents and Trademarks*